US009311816B2

(12) United States Patent
Engler et al.

(10) Patent No.: US 9,311,816 B2
(45) Date of Patent: Apr. 12, 2016

(54) VEHICLE IDENTIFICATION

(71) Applicant: Intelligent Imaging Systems Inc., Edmonton (CA)

(72) Inventors: Wolfgang Engler, Edmonton (CA); Brian Heath, Edmonton (CA); Cedar Mah, Edmonton (CA)

(73) Assignee: Intelligent Imaging Systems, Inc., Edmonton (CA)

( * ) Notice: Subject to any disclaimer, the term of this patent is extended or adjusted under 35 U.S.C. 154(b) by 78 days.

(21) Appl. No.: 14/348,026

(22) PCT Filed: Sep. 27, 2012

(86) PCT No.: PCT/CA2012/050679

§ 371 (c)(1),
(2) Date: Mar. 27, 2014

(87) PCT Pub. No.: WO2013/044389

PCT Pub. Date: Apr. 4, 2013

(65) Prior Publication Data

US 2014/0232563 A1 Aug. 21, 2014

Related U.S. Application Data

(60) Provisional application No. 61/539,927, filed on Sep. 27, 2011, provisional application No. 61/539,583, filed on Sep. 27, 2011.

(51) Int. Cl.

| | |
|---|---|
| ***G08G 1/01*** | (2006.01) |
| ***G08G 1/042*** | (2006.01) |
| ***G08G 1/017*** | (2006.01) |

(52) U.S. Cl.
CPC ..... *G08G 1/042* (2013.01); *G08G 1/017* (2013.01)

(58) Field of Classification Search
CPC ..... G08G 1/20; G08G 1/017; G05D 1/0259
USPC ..... 340/933, 551, 552, 941; 180/167, 282, 180/290
See application file for complete search history.

(56) References Cited

U.S. PATENT DOCUMENTS

| | | | | |
|---|---|---|---|---|
| 5,491,475 | A * | 2/1996 | Rouse et al. | 340/933 |
| 6,208,268 | B1 * | 3/2001 | Scarzello et al. | 340/941 |
| 6,342,845 | B1 * | 1/2002 | Hilliard et al. | 340/941 |
| 6,556,927 | B1 * | 4/2003 | Latta | 702/41 |
| 6,662,099 | B2 * | 12/2003 | Knaian et al. | 701/117 |
| 7,765,056 | B2 | 7/2010 | Cattin | |
| 9,092,982 | B2 * | 7/2015 | Robinet et al. | |

(Continued)

OTHER PUBLICATIONS

International Search Report mailed Jan. 8, 2013, issued in corresponding International Application No. PCT/CA2012/050679, filed Sep. 27, 2012, 3 pages.

*Primary Examiner* — Phung Nguyen
(74) *Attorney, Agent, or Firm* — Christensen O'Connor Johnson Kindness PLLC

(57) ABSTRACT

Magnetometers under the road surface detect variations in the vertical and longitudinal horizontal components of the magnetic field over time in response to passing vehicles. A trajectory of these components in the phase space of these field components is regularized to obtain a magnetic signature. Magnetic signatures are compared using cross-correlation over arc length to identify vehicles. Inductance sensors can be used to detect vehicles and help determine the beginning and end of magnetic signatures.

26 Claims, 5 Drawing Sheets

(56) References Cited

U.S. PATENT DOCUMENTS

2002/0190856 A1* 12/2002 Howard ..... 340/531
2007/0101596 A1* 5/2007 Olson et al. ..... 33/356
2008/0169385 A1 7/2008 Ashraf
2013/0057264 A1* 3/2013 Robinet et al. ..... 324/207.24

* cited by examiner

VEHICLE IDENTIFICATION

TECHNICAL FIELD

Vehicle Identification

BACKGROUND

Measurement of the magnetic field of moving vehicles is known. If vehicles always moved at a single speed, the signals could be correlated directly. Since vehicles change speeds and do so unpredictably, the form may be stretched or compressed or distorted into regions of variable stretching and/or compression. Some parts of the signal remain repeatable. The industry convention is to hit on the simplest method. A single component, most commonly the z component, is selected for consideration. Maxima and minima are detected in the data stream, and are listed in order min[1], max[1], min[2], max [2], min[3], max[3], and so on. These values are directly correlated.

Problems with the conventional method include throwing out almost all information aside from extrema for an arbitrary field coordinate right at the outset; magnetic fields are treated as disjoint measurements with all spatial and time-evolution theory discarded entirely; and the statistics of maxima and minima vary significantly amongst vehicles, with small numbers of extrema often dominated by leading and trailing extrema. Sensible and repeatable interpretation of respective statistics suffers severe limitations.

SUMMARY

To address the problems in the conventional approach, we work directly in 2 or 3 dimensions. The result we are aiming for is a repeatable measure, which is independent of vehicle acceleration or deceleration. We want to keep field evolution measurements. We want to generate a repeatable data set with known statistical characteristics. And we want the result to be repeatable and independent of velocity and acceleration profiles for the moving vehicle.

A method of vehicle identification is provided. A change is sensed in a magnetic field in at least two components at a first location due to movement of a vehicle to produce an event record that includes a vehicle magnetic signature corresponding to the change, the vehicle magnetic signature is compared to a database of saved records that include stored magnetic signatures; and the event record is associated with a saved record in the database when a match is obtained between the vehicle magnetic signature and the stored magnetic signature of the saved record. An action may be performed when a match is obtained.

The vehicle's velocity and acceleration profiles may be unknown, and the vehicle's motion may include multiple unknown stops and restarts, intermittently throughout the period where the event record is produced. The change in the magnetic field may be detected in two or three components. Each saved record may include an entry corresponding to one or more of the weight of the vehicle, the speed of the vehicle, and the license number of the vehicle. The sensed change in a magnetic field may be a change of the earth's magnetic field. The change in the magnetic field may be sensed using synchronized magnetometer arrays.

The first location may be at a road and the stored magnetic signatures may be generated by sensing a change in a magnetic field in at least two dimensions at a second location due to movement of vehicles along the road at the second location, the second location being a location past which vehicles travel before reaching the first location.

The vehicle magnetic signature and the stored magnetic signature may be compared using, for example, a cross-correlation. The cross-correlation may be performed on a constructed time and process independent measure. The cross-correlation and measure may both be constructed from measured magnetic field components in at least two dimensions. A constant velocity and/or spatially reconstructed equivalent of the vehicle's magnetic field change record may be calculated.

The magnetic signature may a regularized trajectory of the magnetic signal in the phase space of the sensed components of the magnetic field. In particular, the constructed time and process independent measure may comprise a regularized trajectory of the magnetic signal in the phase space of the sensed components of the magnetic field. The cross-correlation may be calculated over arc-length of the regularized trajectory. The Fisher Z of the cross-correlation may be taken to compare the signatures.

Additional sensor data can be used in combination with the sensed change in at least two components of a magnetic field at the first location, for example to detect the presence of the vehicle. The additional sensor data can be used to determine the boundaries of the change in at least two components of a magnetic field at the first location due to movement of the vehicle. The additional sensor data may comprise data generated by an inductance sensor.

An apparatus for vehicle identification may include at least a magnetometer arranged to provide a time dependent output corresponding to a recording of a magnetic field that varies in time in at least two of the magnetic field's components; a processor or processors having as input the output of at least a magnetometer, the input forming acquired data; a database of saved records, each saved record comprising at least a stored magnetic signature identified with a vehicle; and the processor or at least a processing part of the processor being configured to operate on the input, generate a magnetic signature corresponding to a change in the magnetic field due to a vehicle passing over at least a first magnetometer and a second magnetometer, compare the generated magnetic signature with the database of stored magnetic signatures and associate the generated magnetic signature with a saved record in the database when a match is obtained between the vehicle magnetic signature and the stored magnetic signature of the saved record, and the processor being configured to perform an action when a match is obtained. The apparatus may also include at least an inductance sensor, and in the processor may also have as input the output of the inductance sensor, the output of the inductance sensor forming inductance data, and the processor may also be configured to operate on the inductance data to detect the vehicle and determine the boundaries of the change of the magnetic field due to the vehicle passing the at least a magnetometer.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1:
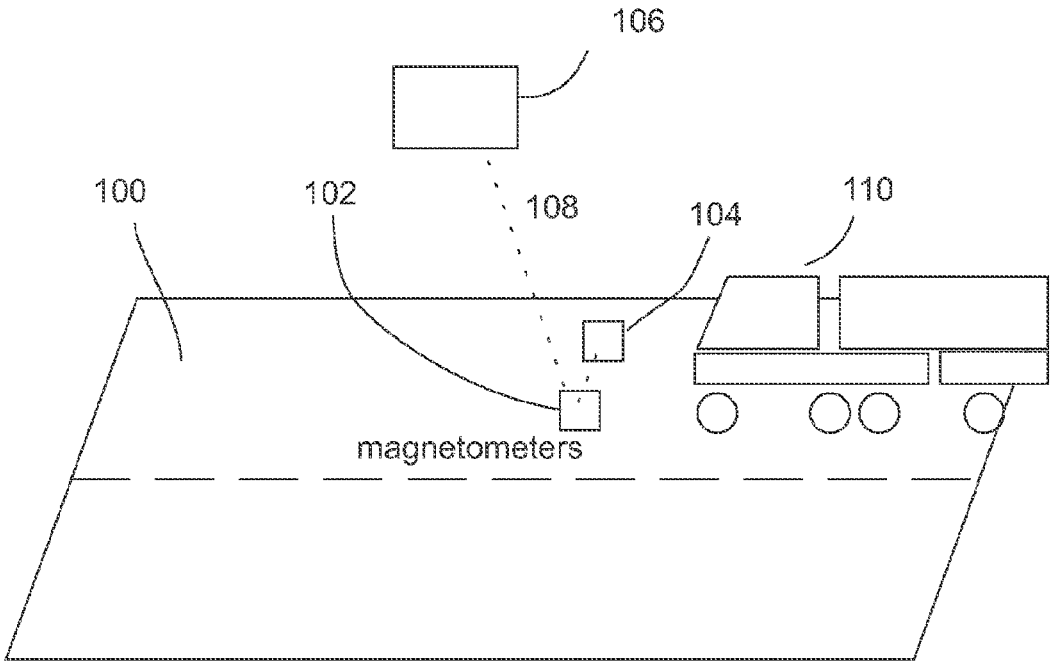
FIG. 1 shows a road surface with buried magnetometers and a processor.

A vehicle in a background magnetic field, for example the earth's magnetic field, will cause a distortion of the magnetic field due to linear paramagnetic/diamagnetic and nonlinear ferromagnetic effects. Ferromagnetic and electromagnetic effects are persistent and are in this sense actively caused by the vehicle. At large distances from the vehicle, the distortion will resemble a magnetic dipole superimposed on the background field. At shorter distances, the distortion will be more complicated due to the details of the vehicle's structure. Although vehicles contain moving parts, which cause changes in the distortion to the background field, most of the structure of a vehicle will typically be moving in an essentially rigid manner. As a result, in a constant background field a vehicle with constant orientation will have a fairly constant associated distortion of the background field, the distortion moving along with the vehicle. Electronic vehicle components also create associated magnetic fields independently of any background field, but low frequency measurements of the field outside the vehicle are typically dominated by the background field distortion. In the preferred embodiment a low pass filter is included in the observations of the magnetic field. At high latitudes the Earth's background field is nearly vertical resulting in a physical dipole approximated by a magnetic charge at the bottom of the vehicle and an opposite magnetic charge at the top of the vehicle. For magnetometers placed a short distance under the road surface, this results in significant near field effects making it easier to distinguish vehicles. At lower latitudes performance of the system may decline.

A magnetometer or magnetometers may be placed to detect the distortion of a passing vehicle. Magnetometers may be placed, for example, under the road surface. The magnetometers detect the near field dipole as a carrier, also detecting higher order (spherical) harmonics as signals. The near field large scale dipole models asymptotically as a local near-field monopole with balancing opposing monopole in the far field. We make use of a scale invariance from this phenomenon, in order to achieve a repeatable signature. The low order field traces a good approximation to an ellipse in phase space. A repeatable correlation measure is constructed from the signal, and then a correlation coefficient calculated for deviation from the elliptical low order carrier. Magnetic vector superposition of higher order harmonics onto the low order carrier comprises the repeatable correlation signature.

An array or arrays of magnetometers aligned perpendicularly to the expected direction of motion of vehicles may be used. A simple implementation uses the array as a line-scan 3-d field measurement. Reconstructions use a best subset of the magnetometers, from a single unit to several to all units. As described above, the low order harmonics act as a carrier for our signal, from which our repeatable measure derives. No averaging is needed. It is also not required to measure the velocity, either with direct or indirect velocity measurements, requiring only an upper limit on vehicle speeds, and that vehicles track linearly through the sensor array, without significant changes in direction of motion. Velocity changes, including variable accelerations and decelerations have no effect. The vehicle may even stop and restart repeatedly without changing results.

In principle, a single magnetometer (measuring the change of multiple components of the magnetic field over time) could be used if vehicles were positioned sufficiently consistently between different passes of the measuring apparatus. However, in practice it is helpful to have multiple magnetometers to deal with, for example, variability in the positioning of a vehicle within a lane.

Figure 6A:
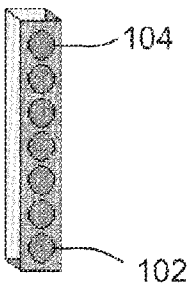
FIG. 6A shows inductance loops in front of and behind a line of magnetometers.
Figure 6A:
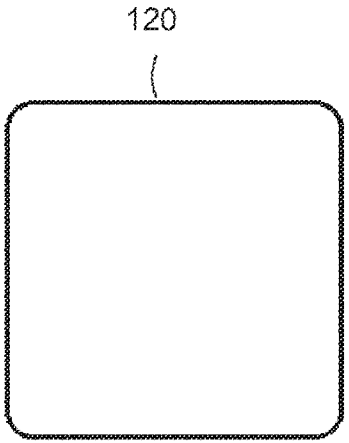
Figure 6B:
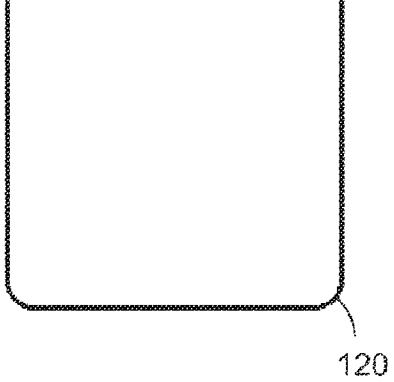
FIG. 6B shows two inductance loops in front of a line of magnetometers.
Figure 6B:
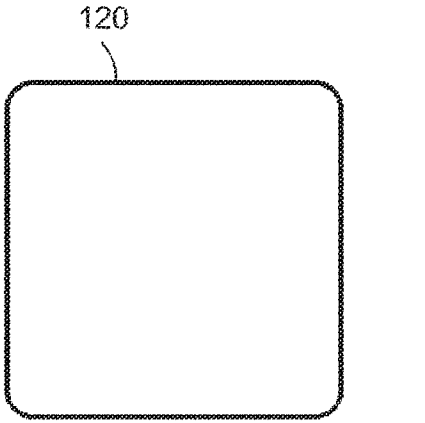
Figure 6B:
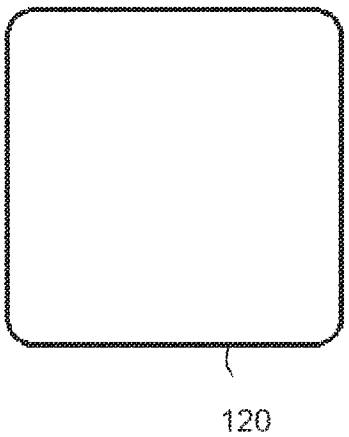

An inductive loop or other vehicle detection sensor can be used to assist in framing (start and stop data acquisition) of the magnetic signature. Issues affecting performance in magnetic detection and framing include following: tail-gating traffic, raised trailer hitches, and long wheel-base stainless steel or aluminum trailers. Non-ferromagnetic metals like stainless steel or aluminum do not strongly affect local low frequency magnetic fields; as conductors, they do however register a strong signal on local high frequency magnetic inductance sensors. Thus vehicle detection and framing and magnetic signature measurement can be improved using inductance sensors in addition to signature detection magnetometer arrays. FIGS. 6A and 6B are images of possible loop and magnetometer arrangements to help with signal detection and framing. In each figure, an embodiment is shown with a line of magnetometers 102 to 104 and two inductance loops 120. In other embodiments, different numbers and arrangements of these elements could be used. In the embodiment shown in FIG. 6A, there is one inductance loop in front of the line of magnetometers and one inductance loop behind the line of magnetometers. In the embodiment shown in FIG. 6B, there are two inductance loops in front of the line of magnetometers.

Use of magnetometer signals in combination with other sensor information helps reduce the likelihood of starting or stopping vehicle signature detection too early or too late. Errors in detection or framing include cutting off the front or back end of a vehicle signature from the data, or including data from other vehicles' signatures before or after the correct vehicle signature interval. In the worst cases several of the foregoing errors could be made in processing a single vehicle signature. In the invention as tested without detection loops, detection and framing errors were the largest identified source of matching errors in magnetic re-identification.

Referring to FIG. 1, a road surface 100 allows vehicles to pass by the apparatus. In this embodiment, an array of magnetometers 102 . . . 104 are buried under the road surface. In an embodiment the array contains 8 magnetometers placed 5-7 inches apart and 3 inches below the road surface in a line orthogonally oriented with respect to the direction of motion of vehicles 110. Other numbers and arrangements of magnetometers may also be used, or the magnetometers may be placed other than under the road surface. The magnetometers communicate with a processor 106 via one or more communication links 108. Although a single processor 106 is shown, the processor 106 may comprise a single board computer (SBC or processor) forming a first processing part which acquires the data synchronously from one or more magnetometers for an entire vehicle and a second processor forming a second processing part. The first processing part passes the complete data set of acquired data to the second processing part where the acquired data is operated on according to the method steps disclosed. Various configurations may be used for the processor 106, including using multiple processing parts. The processor 106 may also include a database of saved records. The database may be formed in any suitable persistent computer readable memory. The saved records may comprise the data disclosed in this document. The processor 106 may also access a physically separate database located elsewhere and connected to a processing part of the processor 106 via a communication link or network such as the internet.

The communication link may be, for example, a wired or wireless link, and may include local processing for data and communications formatting. The magnetometers should preferably be kept in a fixed position and orientation with respect to the road surface.

Figure 2:
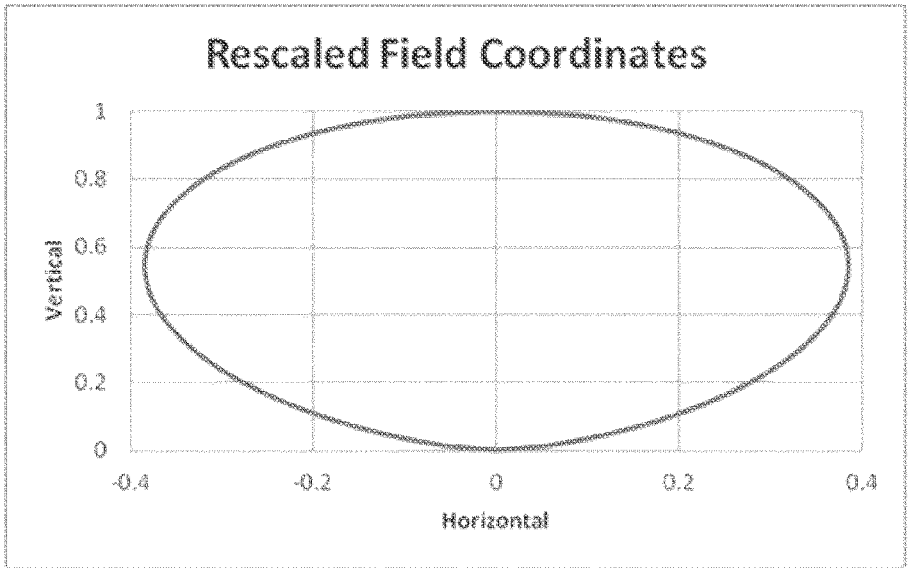
FIG. 2 is a diagram of an approximate shape of the trajectory of observations in the phase space of the vertical and longitudinal horizontal components of a magnetic field, not including details of the magnetic signature.
Figure 3:
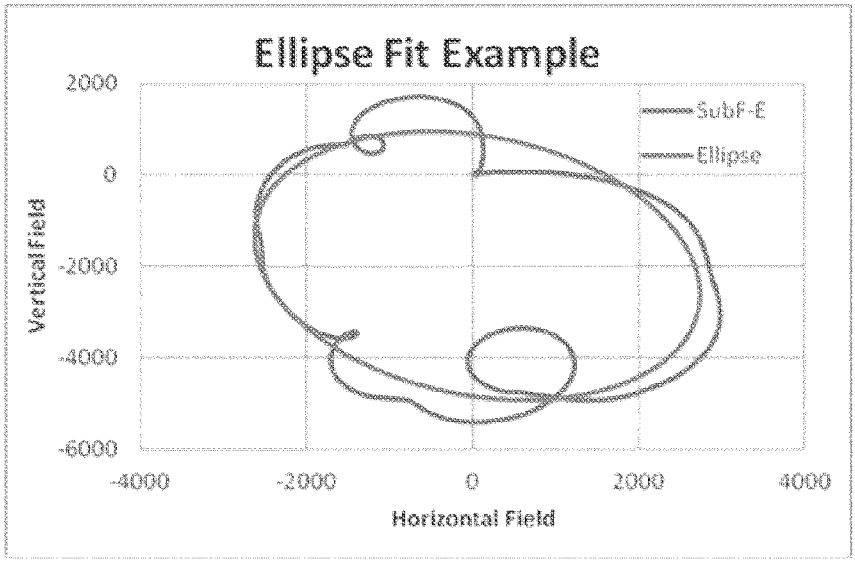
FIG. 3 is an example of a trajectory of observations in the phase space of the vertical and longitudinal horizontal components of the magnetic field, with an ellipse fit to the trajectory.
Figure 2A:
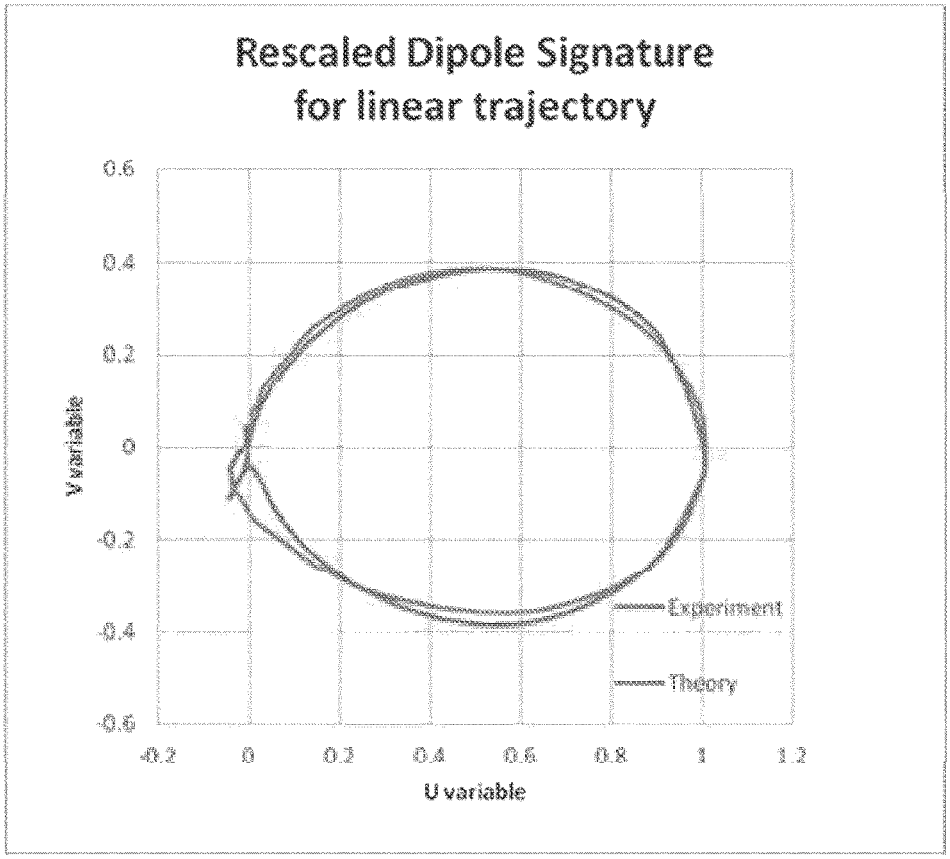
FIG. 2A is a second embodiment of an approximate shape of the trajectory of observations in the phase space of the vertical and longitudinal horizontal components of a magnetic field, not including details of the magnetic signature, showing both experiment and theoretical shape, re-scaled, for a cast iron cooking pot sensed according to the methods disclosed herein.

The magnetometers measure at least 2 components of the magnetic field. In a preferred embodiment, the fields in the x direction (longitudinal to the direction of motion) and z direction (vertical) are used. The changes in each component may be plotted against each other to get a trajectory in the space of the field components (FIGS. 2-3).

In our case, the near field magnetic field is asymptotic to the effect of the dominant local magnetic pole. With velocity and distance suppressed, and knowing only that measurements are on a linear trajectory with single orientation, the resulting vector field components may be rescaled, mapping to a single mathematical curve. This curve has the formula U^2+V^2−U^(4/3), and is depicted in FIG. 2, and is to good approximation elliptical. We make use of the elliptical approximation in constructing the repeatable measure for cross-correlation.

The trajectory of the observations in the magnetic component space is fitted to an ellipse, which is rescaled to produce a circle of known radius, by ray projection from the centre, and the trajectory being projected and rescaled with the same transformation. The resulting deviations of the trajectory from the circle as a function of arc length from the point most closely corresponding to the origin comprise the magnetic signature. Fitting an ellipse to the actual signal produces an elliptical carrier with perceived signal averaging away for real experimental measurements, as shown in FIG. 3. Elliptical fitting allows conformal rescaling and transformation into repeatable arc length along the signature. Vehicle velocity, acceleration or whether stops and restarts occur have no effect on the signature trace, and thus no effect on matching behavior. Deviations from the ellipse give very nearly Gaussian random variables with respect to rescaled arc-length measure. Cross-correlations of the deviations between signals so constructed have well understood properties. Experimental repeatability is in good accord with theoretical predictions, especially when mismatched vehicle signatures are compared and the match is rejected. Statistics for good matches in re-identifying a vehicle as a match to itself however vary somewhat amongst vehicle classes.

Figure 4:
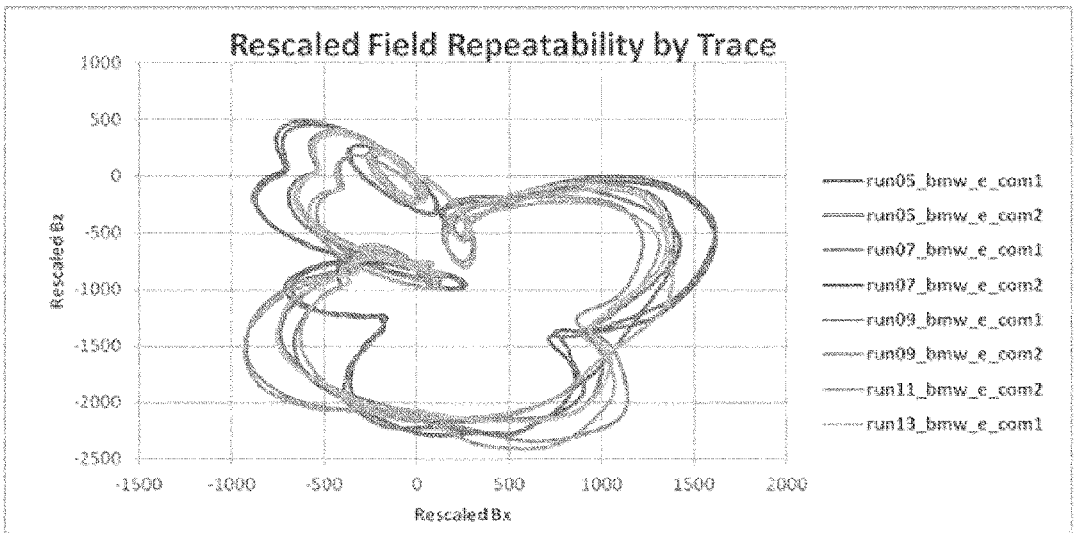
FIG. 4 shows an example of trajectories of observations in the phase space of the vertical and longitudinal horizontal components of the magnetic field, for repeated observations of the same car, in some cases displaced transversely relative to others.

There are good theoretical and practical reasons why higher order signal contributions should scale with the dominant low order terms. Important considerations include vehicles' construction, clearance and rigidity, field measurements with fixed orientation along a linear vehicle trajectory, and measurement of magnetic field effects in the near field. Whenever sensor trace offsets for traces are repeated, elliptical rescaling removes rescaling errors and hysteresis offsets to good asymptotic approximation. Note trace pairs in this repeatability plot shown in FIG. 4.

A cross-correlation can be performed on the resulting magnetic signatures to compare them and determine if they correspond to the same vehicle More complex implementations are possible. Reconstruction of the rigid vehicle signal is theoretically possible. This concept was experimentally tested in February 2011, with the result that ~95% of vehicles could be repeatably reconstructed to about 9" precision from experimental data. In practice however, 95% reconstruction means re-identification using two measurements would be limited to ~0.95 squared=~0.90=~90%. Matching reliability from interference methods explicitly avoiding rigid vehicle reconstruction is experimentally better than 95%.

Cross-correlations may be converted into Fisher-Z statistics. This conversion is a form of variance stabilization. The Fisher-Z statistic is known to be approximately Gaussian for experimental cross-correlations of approximately Gaussian signals. Statistics of the Fisher-Z are useful for describing noise in many signal correlation phenomena, including for example laser speckle interferometry.

Figure 5:
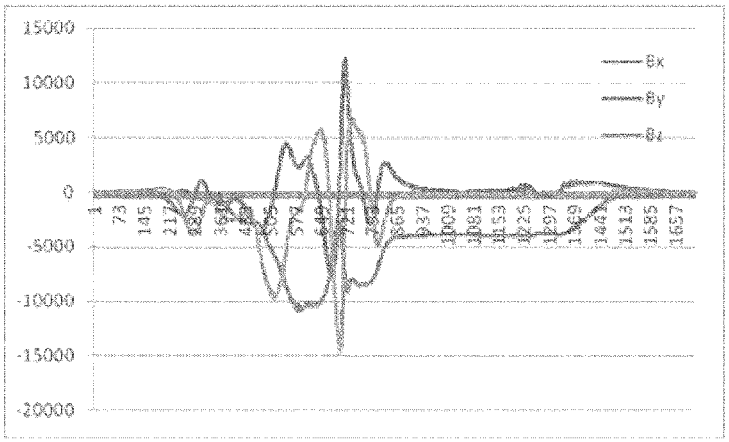
FIG. 5 shows an example framed signal of the magnetic field components observed when a vehicle passes the equipment.

Several alternative methods may be applied to match new magnetic signatures to existing magnetic vehicle records. One way to compare two magnetic signatures may involve a cross-correlation of a magnetic field component or of a function of magnetic field components. The simplest implementation would be a cross correlation between two magnetic signatures, each signature being a detected change over time of a magnetic field component. This implementation has two immediate problems. The first problem is that two different magnetic signatures for the same vehicle could have a low cross-correlation if vehicle velocity was fixed during signature acquisitions, but velocity of the vehicle was different in each of the two separate acquisitions. The fixed velocity problem can be resolved by calculating a constant velocity equivalent for each individual signature or by compressing or stretching the vehicle signature in time-indexing, with speculative cross-correlations for each interpolated time-indexing. The second problem is that two different magnetic signatures for the same vehicle could have a low cross-correlation if vehicle velocity changed during the acquisition of the magnetic signature during either the first or the second measurement, or during the acquisition of both measurements. Since vehicles' acceleration profiles, including possible stops and restarts is unknown, the variable velocity problem is far more difficult to resolve. A possible approach involves synchronized measurements involving multiple magnetometers. For example, two magnetometers can be used with a first sensor downstream in the traffic flow and a second sensor a distance upstream from the first. Magnetic field evolutions in time are compared between the two sensors, and time-shifted fields from the (first) downstream sensor matched with earlier magnetic field events detected at the (second) upstream sensor. Time differences may be used to calculate average speeds between the upstream and downstream sensors, and from average velocity to calculate vehicle displacement as a function of time. Using the velocity and displacement record calculated in this way, a magnetic field change record can be adjusted to produce an estimated constant velocity equivalent or a spatially reconstructed equivalent Single Sensor Algorithm In order to keep this description relatively simple, let us stick to the convention that vertical field (z direction) is upwards and the x component of the horizontal field is in the direction of vehicle motion along the traffic flow. We detect a vehicle presence as a persistent deviation from the statistical mode (component by component) in the magnetic field. To be precise, detection is by median magnitude of the vector field difference from the background mode, being above a fixed threshold on a fixed time interval. We frame a vehicle by taking data from when the statistic is above threshold, and augmenting with head and tail regions to capture full signals leading into and trailing off from the vehicle. The result is a framed signal of the form shown in FIG. 5.

The algorithm for vehicle identification is as follows: We take a properly framed signal for a detected vehicle as described above, and apply the signature regularization procedure, cross-correlation algorithm and statistical determination of a match as shown below.

Signature Regularization Procedure

1) We copy out a set of paired longitudinal horizontal and vertical components, indexed sequentially by time, as the measurements are taken;

2) We perform an unweighted ellipse fit to the data. We calculate the best fit ellipse parameters;

3) We perform the natural circularizing mapping from the data set to a centered circle, taking care to preserve angles. Radii from the ellipse centroid are mapped by projection, rescaling distance from the centroid, but leaving angle about the centroid invariant;

4) We calculate arc length, using fast fourier transforms and local h-splines, along the time evolution of the signal for the two dimensional data points and interpolate the signal into a new index with constant difference steps in arc length. The newly indexed signal usually contains between 256 and 1024 indexed measurements.

5) We repeat steps 3 and 4 a few times. In the current algorithm this is 4 times. The effect is that the inferred arc-length measure and elliptical fit parameters converge to a repeatable form.

6) We keep this data set for use in cross-correlation

Cross-Correlation Algorithm

1) We start with two signatures prepared by the Signature Regularization Procedure.

2) We choose a maximum allowable offset in arc index, typically approximately 1/16 radian.

3) We call one signature p and the other q for the purposes of the following.

4) Use p first, and set p aside as fixed for now. For each indexed entry of p we find the interpolated closest approach q' of sequence q to the particular entry for p, within the allowable offset in arc, but excluding the endpoints. When no closest approach exists, we use the centre of the allowable region.

5) With the paired list data for p and q we perform cross-correlation by fourier correlation to find the optimal value. The variables for the cross-correlation are the respective simple radii for p and q'. We keep the respective cross-correlation value.

6) We interchange p and q and repeat steps 4 and 5

7) We return as resultant the maximum value of the two correlations and Fischer-Z value of the maximum correlation.

If there is more than one sensor, we can still produce a single resultant by comparing all possible pairs of sensors (with one element of the pair being from the measurement of the first signature and the other element of the pair being from the second signature). We preferably include interpolated values between sensors, such as by using polynomial interpolation, and at angles going through the sensor array, to take into account the case of a vehicle trajectory not being perfectly parallel to the laneway. This latter case occurs more commonly at lower speeds. In a preferred embodiment, the pair of sensors or pair of interpolated positions between sensors that has the maximum correlation value or Fischer-Z value is used.

In an alternative embodiment, the measurements between sensors are time synchronized, and arc length is modified to be calculated from rms averaged differentials between sensors. The weighting for the fit derives from the rms averages, but sensor pairs are correlated according to the usual cross-correlation algorithm, but all corresponding sensor pairs are pooled. The full set or a subset of sensors are matched sequentially by position.

In a further embodiment, the y (transverse horizontal) component of the magnetic field is also used. The ellipse becomes an ellipsoid in this case, and the circle becomes a sphere. The other elements of the analysis may remain the same. Linear combinations of the horizontal components of the field may also be used, or two components of the field other than the vertical and longitudinal horizontal components of the field may be used.

Statistical Determination of a Match

In practice, a threshold level for a match needs to be chosen. In order to choose a threshold value, we do the following: we measure a small set of vehicles (typically 300) and cross-correlate vehicle signatures with one another. The Fischer-Z of the cross-correlation of non-matching vehicles, follows an easily parameterized Gumbel distribution, with nominal experimental parameters of beta=0.16 and mu=0.83. For test sets of N vehicles, we can choose a threshold level to achieve a known chance of error in rejecting matches. For tests where the vehicles truly match, we have more variability between classes in the distribution of Fischer-Z statistics. This variation depends on the class of vehicle. Buses for example are in a different category than heavy transport trucks. The low end tail of the distribution of Fisher-Z statistics for known matches determines the error rate in making real signature matches.

The disclosed method and system may be used in a variety of practical applications. For example, the method and apparatus may be used in conjunction with the thermal inspection system disclosed in U.S. patent publication 20080028846 dated Feb. 8, 2008, the content of which is hereby incorporated by reference. In such an instance, the action to be taken may include detecting when a particular vehicle has passed an inspection location. A thermal record of the vehicle may be associated with the magnetic signature in a saved record to assist in identifying a vehicle that is inspected. The action to be taken may include determining travel time or average speed of a vehicle from signature timestamps of the vehicle between two sensor locations.

The vehicle signature may be sensed at a first location, then sensed again in a second location, both locations being set up in accordance with FIG. 1. Once identified at the first location, the same vehicle may then be identified by its magnetic signature at the second location. Equipment at the locations may be set up to communicate with each other by wire or wirelessly. A single processor may be used that receives inputs from an array at the first location set up in accordance with FIG. 1 and an array at a second location also set up in accordance with FIG. 1. The processor, which may be any suitable computing device with sufficient capacity for the computations required, is configured by suitable software or hardware in accordance with the process steps described here.

The processor may include suitable persistent memory for storage of records or may use persistent memory in any other suitable form including shared memory on a set of servers accessible by any suitable means including via a wired or wireless network such as the internet.

The action to be taken may involve the flagging of a vehicle for further inspection or detention of the vehicle if the vehicle has passed an inspection location without stopping or turning as required. The method and system may also be used in association with a weigh station and used to identify a vehicle that is being weighed. The action to be taken may include identifying the vehicle and associating an identification of the vehicle with weight of the vehicle in a saved vehicle record. The record may also include the speed of the vehicle and the license number of the vehicle. The record may also include photographic images of the vehicle. The record may include information regarding the cargo of a vehicle in transit, or include personal information regarding the current driver of a vehicle in transit. The record may include information on outstanding warrants, outstanding taxes, or Court Orders relating to a vehicle or driver. The record that is generated as a result of a match may be stored in any suitable persistent computer readable storage medium.

In practice, there will a finite number of suspected matches in circumstances involving detecting matches between vehicles passing by two measurement locations. The optimal spacing between measurement locations depends to some degree on traffic consistency and density.

Immaterial modifications may be made to the embodiments described here without departing from what is covered by the claims.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A method of vehicle identification, comprising:

sensing a change in at least two components of a magnetic field at a first location due to movement of a vehicle and producing an event record that includes a vehicle magnetic signature corresponding to the change;

comparing the vehicle magnetic signature to a database of saved records that include stored magnetic signatures;

associating the event record with a saved record in the database when a match is obtained between the vehicle magnetic signature and the stored magnetic signature of the saved record; and performing an action when the match is obtained between the vehicle magnetic signature and the stored magnetic signature;

wherein the first location is at a road and the stored magnetic signatures are generated by sensing a change in a magnetic field in at least two components at a second location due to movement of vehicles along the road at the second location, the second location being a location past which vehicles travel before reaching the first location.

2. The method of claim 1 in which the change is detected in two components.

3. The method of claim 1 in which the change is detected in three components.

4. The method of claim 1 in which each saved record includes an entry corresponding to one or more of the weight of the vehicle, the speed of the vehicle, and the license number of the vehicle.

5. The method of claim 1 in which sensing comprises sensing changes in the earth's magnetic field.

6. The method of claim 1 in which sensing comprises sensing with synchronized magnetometer pairs.

7. The method of claim 1 in which the sensed change in a magnetic field at a second location is a change in three components of the earth's magnetic field.

8. The method of claim 1 in which the sensed change in a magnetic field at a second location is a change in two components of the earth's magnetic field.

9. The method of claim 1 further comprising sensing at the second location and saving in a corresponding saved record one or more of the weight of the vehicle, the speed of the vehicle, and the license number of the vehicle.

10. The method of claim 1 in which comparing comprises a cross-correlation, and a match is determined by a cross-correlation exceeding a pre-defined threshold.

11. The method of claim 10 in which cross-correlation is performed on a non-linear and/or variance stabilized statistic where such a statistic is constructed to optimize statistical identification.

12. The method of claim 10 in which the cross-correlation is performed on a constructed time and process independent measure.

13. The method of claim 12 in which the constructed time and process independent measure comprises a regularized trajectory of the magnetic signal in the phase space of the sensed components of the magnetic field.

14. The method of claim 13 in which the cross-correlation is calculated over arc-length of the regularized trajectory.

15. The method of claim 13 in which the cross-correlation is calculated over arc-length of the regularized trajectory.

16. The method of claim 12 in which the cross-correlation and measure are both constructed directly from measured magnetic field components in at least two dimensions.

17. The method of claim 12 in which the constructed time and process independent measure comprises a regularized trajectory of the magnetic signal in the phase space of the sensed components of the magnetic field.

18. The method of claim 12 in which the cross-correlation and measure are both constructed directly from measured magnetic field components in at least two dimensions.

19. The method of claim 10 further comprising taking a Fisher-Z of the cross-correlation to compare the signatures.

20. The method of claim 1 in which the magnetic signature is a regularized trajectory of the magnetic signal in a phase space of the sensed components of the magnetic field.

21. The method of claim 1 in which a constant velocity and/or spatially reconstructed equivalent of the vehicle's magnetic field change record is calculated.

22. The method of claim 1 further comprising using additional sensor data in combination with the sensed change in at least two components of a magnetic field at the first location.

23. The method of claim 22 further comprising using the additional sensor data to detect the presence of the vehicle.

24. The method of claim 22 further comprising using the additional sensor data to determine the boundaries of the change in at least two components of a magnetic field at the first location due to movement of the vehicle.

25. The method of claim 22 in which the additional sensor data comprises data generated by an inductance sensor.

26. A method of vehicle identification, comprising:

sensing a change in at least two components of a magnetic field at a first location due to movement of a vehicle and producing an event record that includes a vehicle magnetic signature corresponding to the change;

comparing the vehicle magnetic signature to a database of saved records that include stored magnetic signatures;

associating the event record with a saved record in the database when a match is obtained between the vehicle magnetic signature and the stored magnetic signature of the saved record; and performing an action when the match is obtained between the vehicle magnetic signature and the stored magnetic signature;

wherein comparing comprises a cross-correlation performed on a constructed time and process independent measure, and the match is determined by the cross-correlation exceeding a pre-defined threshold.

* * * * *